US009863217B2

(12) United States Patent
Cooper

(10) Patent No.: US 9,863,217 B2
(45) Date of Patent: Jan. 9, 2018

(54) MAGNETIC CLEANING TOOL

(71) Applicant: Servwell Engineering Limited, Dundee (GB)

(72) Inventor: Ruairidh Andrew Cooper, Banchory (GB)

(73) Assignee: SERVWELL ENGINEERING LIMITED (GB)

( * ) Notice: Subject to any disclaimer, the term of this patent is extended or adjusted under 35 U.S.C. 154(b) by 297 days.

(21) Appl. No.: 14/414,746

(22) PCT Filed: Jul. 17, 2013

(86) PCT No.: PCT/GB2013/051910
§ 371 (c)(1),
(2) Date: Jan. 14, 2015

(87) PCT Pub. No.: WO2014/013250
PCT Pub. Date: Jan. 23, 2014

(65) Prior Publication Data

US 2015/0192000 A1 Jul. 9, 2015

(30) Foreign Application Priority Data

Jul. 18, 2012 (GB) ..... 1212725.4

(51) Int. Cl.
*E21B 37/00* (2006.01)
*E21B 31/06* (2006.01)

(52) U.S. Cl.
CPC ..... *E21B 37/00* (2013.01); *E21B 31/06* (2013.01)

(58) Field of Classification Search
CPC ..... E21B 37/00; E21B 17/006; E21B 31/06; E21B 12/06
See application file for complete search history.

(56) References Cited

U.S. PATENT DOCUMENTS 2,628,822 A 2/1953 Herndon
3,509,941 A * 5/1970 Davis ..... E21B 34/06 166/149

(Continued)

FOREIGN PATENT DOCUMENTS

GB 2364539 A 1/2002
GB 2350632 B 10/2003

(Continued)

*Primary Examiner* — Brad Harcourt
(74) *Attorney, Agent, or Firm* — Law Office of Jesse D. Lambert, LLC

(57) ABSTRACT

A magnetic cleaning tool for collecting ferrous debris in a wellbore and a method of cleaning a wellbore. The magnetic cleaning tool has a tool body for attachment in a work string, one or more magnets supported on the tool body, and a sleeve located around the tool body which is arranged to be moveable along the body to provide selective coverage of the magnets. Embodiments are described providing shear pins and spring loaded balls to hold the sleeve either over the magnets or free of the magnets. An expandable piston, moveable by action of a drop ball, is described to release the sleeve. The sleeve is arranged so that the magnets can be covered and therefore effectively inactive on run-in and during downhole operations, and uncovered to be active when pulled out of the wellbore.

19 Claims, 1 Drawing Sheet

(56) References Cited

U.S. PATENT DOCUMENTS

| | | | | |
|---|---|---|---|---|
| 5,666,050 | A * | 9/1997 | Bouldin | E21B 47/0905 166/66.5 |
| 5,699,577 | A | 12/1997 | Rankin | |
| 6,354,386 | B1 * | 3/2002 | Ruttley | E21B 31/06 166/66.5 |
| 6,655,462 | B1 | 12/2003 | Carmichael et al. | |
| 2002/0005297 | A1 * | 1/2002 | Alft | E21B 7/046 175/26 |
| 2005/0028982 | A1 * | 2/2005 | Howlett | E21B 29/00 166/310 |
| 2007/0107894 | A1 | 5/2007 | Ruttley | |
| 2009/0025927 | A1 * | 1/2009 | Telfer | E21B 21/103 166/174 |
| 2010/0181064 | A1 * | 7/2010 | Knobloch | E21B 27/00 166/99 |
| 2013/0000884 | A1 * | 1/2013 | Linklater | E21B 37/00 166/66.5 |
| 2015/0145513 | A1 * | 5/2015 | Li | G01N 24/081 324/303 |
| 2016/0047228 | A1 * | 2/2016 | Frosell | G01V 3/081 324/326 |

FOREIGN PATENT DOCUMENTS

| | | | | |
|---|---|---|---|---|
| WO | WO 9219838 | A1 | 11/1992 | |
| WO | WO 2005124098 | A2 | 12/2005 | |
| WO | WO 2006120453 | A1 | 11/2006 | |
| WO | WO 2007136667 | A1 * | 11/2007 | E21B 31/06 |
| WO | WO2007136667 | A1 | 11/2007 | |
| WO | WO 2009002185 | A1 | 12/2008 | |
| WO | WO 2010007434 | A2 | 1/2010 | |
| WO | WO2011095816 | A2 | 8/2011 | |
| WO | WO 2011146253 | A2 | 11/2011 | |

* cited by examiner

MAGNETIC CLEANING TOOL

The present invention relates to a method and apparatus for wellbore cleaning and in particular, though not exclusively, to a magnetic tool which collects ferrous debris for removal from the well.

During drilling and completion of an oil or gas well, debris and foreign particles are deposited in the well bore. These are typically removed by being carried out in the circulating fluid but it is realised that heavier deposits such as metal shavings can be left suspended in the fluid. Well cleaning tools have therefore been developed in order to assist in the removal of the debris. A class of well cleaning tool used to remove the ferrous debris is a magnetic cleaning tool. Such tools operate by having one or more magnets located on the tool body which attract the ferrous material. When the magnetic tool is removed from the wellbore, the ferrous material will have adhered to the magnets to be carried to the surface for disposal.

A disadvantage with some known magnetic tools is that the magnets remain active at all times. As the tool is generally located on a string of multiple tools, there may be tools such as a milling tool which creates debris as the string is run in (RIH) and then used for example in a casing milling or exit application. In this case, instead of the millings being given the opportunity to be circulated from the well, the ferrous debris will collect on the magnetic tool and thus the magnetic tool can become clogged-up on RIH or during the downhole operation making it ineffectual when it is required to clean the fluids on being pulled out of the hole (POOH).

A further disadvantage with some known magnetic tools is that the magnets are held on the tool body in a region between two stabilisers. These stabilisers by their very nature protrude from the string. Accordingly, the magnets are effectively set back from the wellbore wall which may be a tubular such as casing or liner. As a result, the field strength of the magnets is insufficient to reach the wellbore wall and consequently an annulus of fluid containing ferrous material can exist at the wellbore wall. The ferrous material is therefore left in the wellbore and the cleaning is not effective.

A yet further disadvantage with some known magnetic tools is that the magnets must move radially to operate in the wellbore. While such movement can overcome the previously listed disadvantage, such radial movement offers the opportunity for material to stick within the operating mechanisms; requires manipulation of the string from the well surface taking valuable time in the cleaning operation; and such manipulation can reduce the amount of other actions available to be performed from other tools present on the string.

It is an object of the present invention to provide a magnetic cleaning tool and a method of debris removal in a wellbore which obviates or mitigates at least some of the disadvantages in the prior art.

According to a first aspect of the present invention there is provided a magnetic cleaning tool for removing ferrous debris in a wellbore, comprising: a tool body for attachment in a work string, one or more magnets supported on the tool body, a sleeve located around the tool body, the sleeve being moveable along the body to provide selective coverage of the magnets.

By being able to selectively cover the magnets with the sleeve, the magnets can be covered and therefore effectively inactive on run-in and uncovered to be active when POOH.

Preferably, the tool body includes a pair of stops located thereupon.

In this way, the sleeve is limited in its extent of movement between the stops and no stabilisers are required.

Preferably, the stops extend radially from the body by a distance less than or equal to a thickness of the sleeve.

In this way, the magnets can be arranged close to the wellbore wall, at a separation selected by the thickness of the sleeve. In an embodiment one of the stops may be formed from the threaded connector used to connect the tool to the work string.

Preferably, the magnets are permanent magnets. More preferably the magnets are fixed into a surface of the tool body. Optionally, the magnets may be embedded in the tool body to provide a flush surface with the surface of the tool body.

In this way, the magnets do not require to move during operation of the tool. The magnets may thus be of any size and dimensions which are suitable for affixing in the tool.

Preferably, the sleeve includes friction means adapted to engage with an interior surface of the wellbore. The interior surface may be an interior surface of a casing or a liner. The friction means may comprise a plurality of drag blocks arranged on an outer surface of the sleeve.

In this way, the sleeve can be retained against the interior surface so that the tool body moves through the sleeve during RIH and POOH which changes the position of the sleeve relative to the magnets.

Preferably, the sleeve and tool body are arranged such that movement of the tool body downwardly relative to the interior surface urges the sleeve to a first position in which the magnets are covered by the sleeve.

In this way, the sleeve covers the magnets when the tool is RIH and the magnets do not collect any debris.

Preferably, the sleeve and tool body are arranged such that movement of the tool body upwardly relative to the interior surface urges the sleeve to a second position in which the magnets are exposed.

In this way, the sleeve is kept away from the magnets when the tool is POOH so that the magnets can collect ferrous debris.

Preferably, the sleeve is arranged to rotate on the tool body.

In this way, the sleeve does not impede rotation of the work string as it can rotate relative to the work string.

Preferably, the tool includes first retaining means to hold the sleeve in the first position. Preferably the first retaining means comprises a pin located in a corresponding recess. Preferably the recess is a circumferential groove around the tool so that the sleeve may still rotate relative to the tool body while held in the first position. In an embodiment, the groove is on the inner surface of the sleeve and the pin is in the tool body.

By holding the sleeve in the first position, the magnets will remain covered if the tool needs to be raised temporarily or if there is insufficient frictional contact between the sleeve and the interior surface.

Preferably, the tool includes disengagement means to release the sleeve from the tool body when in the first position. Preferably the disengagement means is arranged to shear the pin in response to an increase in fluid pressure in the tool. More preferably, the disengagement means comprises an actuating mechanism. Preferably the actuating mechanism is a radially expanding piston. Preferably, the pin holds the sleeve and the piston in the first position, the piston being located in a longitudinal through bore of the tool.

Preferably the piston includes a longitudinally arranged central bore. Preferably the through bore and central bore are co-linear with each other and a bore of the work string. In this way, fluid can circulate through the tool when located on the work string.

More preferably, the piston includes an upwardly facing first surface extending into the through bore. In this way, an appropriately sized drop ball released into the through bore from surface will travel to and seat at the first surface, thereby blocking the through bore. Fluid pressure will build up to move the piston which shears the pin and releases the sleeve from the first position. Preferably, sheared portions of the pin are retained in the tool to prevent additional loose debris in the wellbore.

Advantageously, the through bore includes a portion having an increased diameter. In this way, the piston can move into the portion and expand. Expansion of the piston can allow the drop ball to pass through the piston and exit the tool in the fluid flow.

Preferably, the tool includes second retaining means to hold the sleeve in the second position. Preferably the second retaining means comprises a spring loaded ball located in a corresponding recess. Preferably the recess is a circumferential groove around the tool so that the sleeve may still rotate relative to the tool body while held in the second position. In an embodiment, the groove is on the tool body and the spring loaded ball arranged in the inner surface of the sleeve. Movement of the sleeve to position the spring loaded ball over the groove, will cause the ball to engage in the groove and retain the sleeve in the second position.

By holding the sleeve in the second position, the magnets will remain uncovered if there is insufficient frictional contact between the sleeve and the interior surface.

Preferably, the sleeve rests against the first stop in the first position and the second stop in the second position. In this way, the stops support the pins and assist in retaining the sleeve in each position.

According to a second aspect of the present invention there is provided a method of cleaning a wellbore, comprising the steps:

(a) mounting a magnetic cleaning tool according to the first aspect on a work string;
(b) running the work string in the wellbore with the sleeve covering the magnets;
(c) pulling the work string from the wellbore;
(d) moving the sleeve so as to uncover the magnets; and
(e) collecting ferrous debris at the magnets.

In this way, the magnets are not collecting debris on the run in or during downhole operation as such collection is not required. They preferentially only collect debris when pulled from the wellbore so as to leave a clean wellbore.

Step (b) may include making frictional contact between the sleeve and an interior wall of the wellbore, so as to maintain the sleeve in a first position over the magnets. More preferably, movement of the tool body downwardly relative to the interior surface of the wellbore urges the sleeve to the first position.

Preferably, step (d) includes making frictional contact between the sleeve and an interior wall of the wellbore, so as to move the sleeve relative to the tool body to a second position clear of the magnets. More preferably, movement of the tool body upwardly relative to the interior surface urges the sleeve to the second position.

Preferably the method includes the step of retaining the sleeve in the first and/or second position. The sleeve may be retained by means of a pin, such as a shear pin or a spring-loaded ball.

Preferably the method includes the step of increasing fluid pressure in the tool to allow movement of the sleeve. More preferably, the fluid pressure is increased by dropping a ball into the tool and providing a seat therein, so that fluid pressure may build up at the ball. Preferably, the method includes the step of moving a piston under the fluid pressure to thereby release the sleeve. Such release may be by shearing the pin. Advantageously, the ball may be released after the sleeve has been moved. Preferably, the piston expands while travelling in the tool to allow the ball to pass therethrough.

Preferably the method includes the step of rotating the sleeve relative to the tool body. More preferably the step of rotating the sleeve relative to the tool body occurs with the step of retaining the sleeve in the first and/or second position.

The method may include additional steps of cleaning using other known cleaning tools such as milling tools, debris catchers, scrapers and brushes.

The invention will now be described, by way of example only, with reference to the accompanying drawings, of which:

Figure 1:
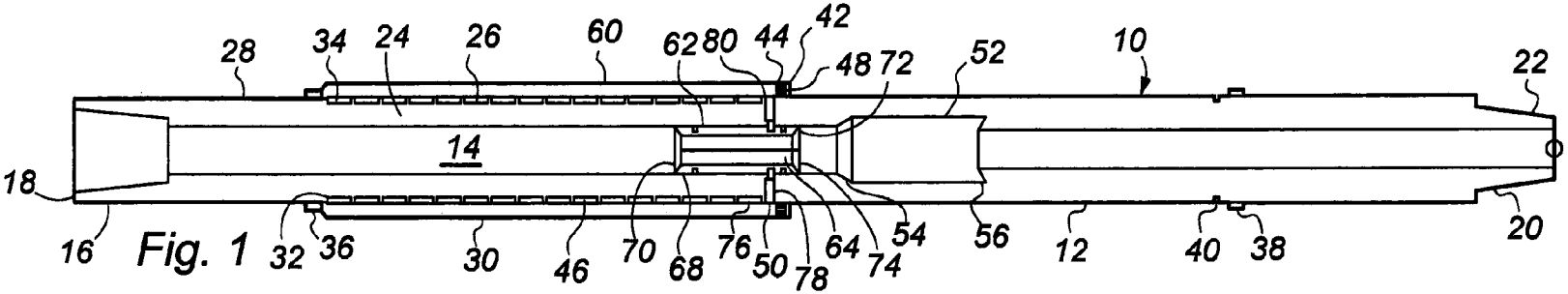
FIG. 1, is a cross-sectional view through a magnetic cleaning tool arranged in a first position according to an embodiment of the present invention.
Figure 2:
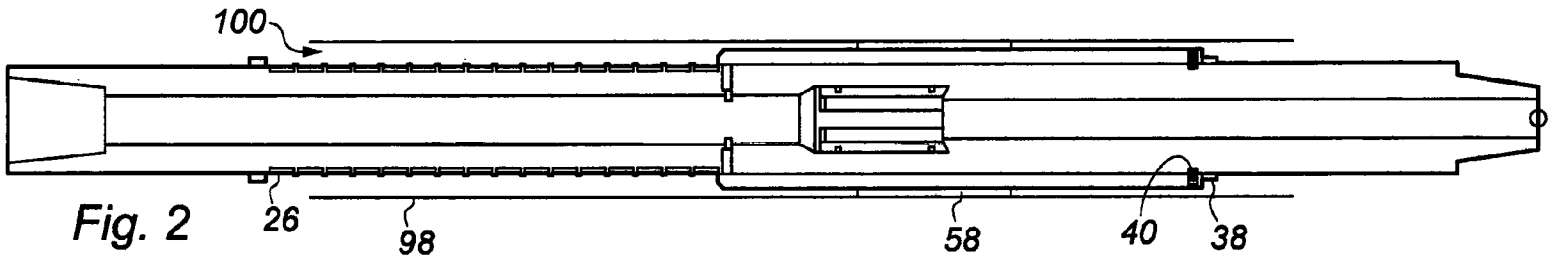
FIG. 2, is a cross-sectional view through a magnetic cleaning tool arranged in a second position within a wellbore according to a further embodiment of the present invention.
Figure 4:
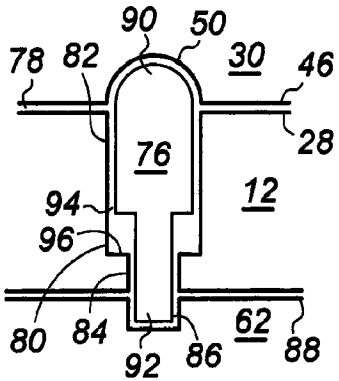
Figure 3B:
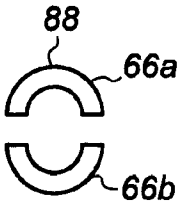
Figure 3A:
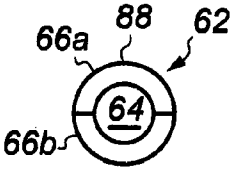

FIGS. 3(*a*) and (*b*) are cross-sectional views through a piston in the (a) first and (b) second positions as provided in FIGS. 1 and 2; and FIG. 4 is an illustration of a fixing point of the magnetic cleaning tool of FIG. 1.

Referring to FIG. 1, there is illustrated a magnetic cleaning tool, generally indicated by reference numeral 10, according to an embodiment of the present invention. The tool 10 includes a tool body 12 being a substantially cylindrical tubular member with a central bore 14 located longitudinally therethrough. The body 12 includes a box section 16 at a first end 18 and a pin section 20 at a second end 22, as is known in the art, for connecting the tool 10 in a work string (not shown). On an upper portion 24 there are arranged magnets 26 on an outer surface 28 of the tool body 12.

Arranged around the body 12 is a sleeve 30 being a tubular member sized to sit close to the outer surface 28 of the tool body 12 while still being free to rotate relative to the tool body and move up and down the tool body 12. The sleeve 30 has a length greater than the length of the upper portion 24 on which the magnets 26 are located. Thus movement of the sleeve 30 relative to the tool body 12 will selectively expose or cover the magnets 26. In this regard, to fully expose the magnets 26, the tool body 12 has a length greater than twice that of the sleeve 30. To assist in movement of the sleeve 30, drag blocks 58, shown in the embodiment of FIG. 2, can be arranged on the outer surface 60 of the sleeve. Sleeve 30 is of a non-magnetic material. At a lower end 42 of the sleeve 30, there is provided a recess 44 on the inner surface 46 of the sleeve 30. In the recess 44 there is housed a spring loaded ball 48. Ball 48 is arranged so that it is compressed and the pin end rests against the outer surface 28. The ball end may be formed from a ball bearing, as is known in the art. Also at the lower end 42, there is arranged a groove 50 which extends circumferentially around the inner surface 46.

The magnets 26 are arranged in rows longitudinally on the tool body 12 and the rows are spaced equidistantly around the circumference of the tool body 12. In an embodiment, between a third and half the length of the tool is covered in magnets 26 to provide a substantial area for ferrous debris collection. The magnets 26 can be of any of any suitable size and shape, for example they may be discs or bar arrangements. The magnets 26 sit in pockets 32 machined into the tool body 12 so that an outer surface 34 of each magnet 26 is flat and in line with the outer surface 26 of the body 12. Such embedding of the magnets 26 in the body 12 assists in preventing the loss of magnets in the wellbore. The magnets 26 may be of any magnetic material known to those skilled in the art. Each magnet 26 is active at the outer surface 34 and as there is no requirement to activate and de-activate the magnets, the magnets can be formed of standard inexpensive material. Additionally the magnets 26 can be fixed in the pockets 32 by any fixing system known to those skilled in the art as they are not required to move at any time during deployment of the tool 10.

Between the first end 18 and the magnets 26 there is arranged a stop 36 on the outer surface 28 of the body 12. Towards the second end 22 there is arranged a further stop 38. Each stop 36, 38 is formed as a ring around the tool body, providing a ledge in the path of the sleeve 30. The stops 36, 38 limit the longitudinal movement of the sleeve 30 on the body 12. Adjacent the lower stop 38 is a groove 40 extending circumferentially around the tool body 12.

Referring now to the central bore 14 of the tool 10 between the pin 20 and box 16 sections, bore 14 has a substantially uniform diameter except for an expanded portion 52. At the expanded portion 52, a length of the bore 14 has a larger diameter. At the upper end 54 of the portion 52, the bore 14 is flared to provide a smooth run-in. At the lower end 56, the flaring continues to provide a trough around the bore 14. Those skilled in the art will be aware that the tool body 12 may be constructed in sections to accommodate the expanded portion 52.

Located within the bore 14 is a piston 62. Piston 62 is a substantially cylindrical member having a bore 64 therethrough to maintain the passage of fluids through the tool 10. The piston is formed in two semi-cylindrical portions 66*a,b* best seen with the aid of FIG. 3. At an upper end 68 of the piston 62 there is provided a ball seat 70. At the lower end 72, the piston 62 is shaped to provide an inner conical surface 74 on the bore 64. The piston 62 is sized such that, in diameter, when the parts 66*a,b* abut, the piston 62 can slide through the bore 14 and, in length, the parts 66 can separate and expand to locate in the expanded portion 52 and provide a larger diameter bore 64.

Movement of the piston 62 is initially impeded by the use of a shear pin 76. In the embodiment shown there are two shear pins, but any number can be used. The shear pin arrangement is seen with the aid of FIG. 4 which illustrates a portion of the tool at the shear pin. At the lower end 78 of the upper portion 24, a stepped bore 80 is provided through the tool body 12. The larger end 82 of the bore 80 is sized to match the groove 50 on the inner surface 46 of the sleeve 30. The narrower end of the bore 80 is sized to match a recess 86 in the outer surface 88 of the piston 62. Recess 86 may be a pocket or a circumferential groove, the choice determining whether the piston can rotate in the bore 14. Pin 76 is sized to provide a head 90 which locates in the groove 50 and a tail 92 which locates in the recess 86. The surface 94 where the head 90 and tail 92 meet is separated from the ledge 96 at the step of the bore 80. The separation is chosen to allow the head 90 to fit entirely in the body 12 and not protrude from the outer surface 28 of the body 12 when the piston 62 is no longer in place.

In use, tool 10 is assembled as shown in FIG. 1. Piston 62 is held in the bore 14 by insertion of the shear pin 76 in the recess 86. The head 90 of the pin 76 sits in the groove 50 of the sleeve 30 and holds in the sleeve 30 in a position where it abuts the stop 36 and covers the magnets 26. This may be considered as the first position.

Tool 10 is then connected in a work string by the conventional connections of the box 16 and pin 20 sections. It is noted that the tool 10 contains no stabilizers or other centralizing features. In this way, the body can have a large diameter so that the distance between the magnets 26 and the wall 98 of a wellbore 100 is within range of the magnetic field of the magnets so that ferrous debris can be collected from the wall 98. This is best seen in FIG. 2.

The tool 10 is run-in the wellbore 100 in the first position as illustrated in FIG. 1. The tool 10 performs no function on RIH. Fluid can be circulated through the central bore 14 and the bore 64 of the piston. With the magnets 26 covered by the sleeve 30, there is no magnetic field at the outer surface 60 of the sleeve. If the work string has to be POOH the sleeve remains in position over the magnets 26. In this first position the sleeve 30 can rotate relative to the tool body 12 by virtue of the pin 76 locating in the circumferential groove 50. This can aid running of the tool 10 as the tool body 12 can rotate with the work string if the sleeve 30 is caused to stop by the debris or contacts the wall 98 by virtue of the drag blocks 58.

When the tool 10 is required to operate, a ball is dropped through the bore of the work string to travel into the bore 14 of the tool 10. The ball will be sized to contact the ball seat 70 on the piston 62 thereby sealing the bore 14. Fluid pressure will build-up behind the ball to provide sufficient force to shear the pin(s) 76 at the outer surface 88 of the piston 62. With the piston 62 released, it will be forced down the bore 14. On reaching the expanded portion 52, the pressure of the ball on the seat 70, will cause the semi-cylindrical sections 66*a,b* to separate, expanding outwards to lie in the expanded portion 52. The conical surface 74 of the lower end 72 of the piston 62 will mate with the trough at the lower end 56 of the expanded portion 52 and hold the piston sections 66*a,b* in place. Expansion of the piston sections 66*a,b* is illustrated on FIGS. 3(*a*) and (*b*), respectively. The piston bore 64 has effectively increased and this is sufficient to allow the ball to drop through the tool 10 and circulation of fluid to be re-established.

With the pin 76 sheared and the piston moved clear of the stepped bore 80, the pin 76 is free to move down so that the surface 94 meets the ledge 96, and the head 90 is located in the tool body 12. This movement is encouraged by the tool 10 now being POOH, so that the tool body 12 will move up through the sleeve 30. This movement is assisted by the drag blocks 58, if present, making frictional contact with the wellbore wall 98 so that the pin head 90 is pushed into the stepped bore 80. The sleeve 30 thus moves relative to the body 12 until the lower end 42 meets the stop 38. In this location the spring loaded ball 48, which has been held in its recess 44 against the outer surface 28 of the body 12, is released into groove 40 and holds the sleeve 30 in this lower position. Advantageously, the sleeve 30 is clear of the lower end 78 of the magnets 26 and sits over the stepped bore 80, to hold the shear pin 76 in the tool body 12. The magnets 26 are now fully exposed and any ferrous debris will now be attracted to the magnets and be retained on the outer surface 28 of the body 12. This may be considered as the second position of the tool 10 and is illustrated in FIG. 2. The tool 10 is pulled from the wellbore 100 and cleans the fluid in the annulus between the work string and the wellbore wall 98 of ferrous debris. Any other debris attached to or caught up in the ferrous debris will also be removed from the wellbore 100. Additionally as the sleeve 30 is now under the magnets 26, the end of the sleeve can assist in preventing any collected material falling back into the annulus.

If the work string needs to be RIH again during POOH to perform any other service such as a further downhole operation, then the tool 10 will remain in the second position by virtue of the ball 48 located in the groove 40. In this position the sleeve 30 can also rotate relative to the body 12 to assist in removal of the work string.

It will be apparent to those skilled in the art that while the phrases 'up' and 'down' together with 'upper' and lower' have been used throughout the specification, they are relative and the tool 10 finds equal use in deviated well bores.

The principle advantage of the present invention is that it provides a magnetic cleaning tool which operates by a simple and reliable movement compared to those of the prior art.

A further advantage of the present invention is that it provides a magnetic cleaning tool which does not require the magnets to be moved or deactivated to operate, the action of the sleeve over the magnets being sufficient to negate the magnetic field.

A yet further advantage of the present invention is that it provides a magnetic cleaning tool which does not operate with stabilizers or centralisers so that the magnets can be brought closer to the wellbore wall to increase the cleaning efficiency.

It will be apparent to those skilled in the art that modifications may be made to the invention herein described without departing from the scope thereof. For example, other mechanisms than the drop ball may be used to release the sleeve from the body. The piston may be operated by other means such as a dart, pressure pulses, electronic flags and such like. The drag blocks shown could be replaced by other pieces which could provide an additional cleaning operation.

I claim:

1. A magnetic cleaning tool for removing ferrous debris in a wellbore, comprising: a tool body being a substantially cylindrical tubular member with a central bore located longitudinally therethrough and connections at a first and second ends for attachment in a work string, one or more magnets supported on the tool body, a sleeve located around the tool body, the sleeve being moveable along the body to provide selective coverage of the magnets and wherein the sleeve and tool body are arranged such that movement of the tool body downwardly relative to an interior surface of the wellbore urges the sleeve to a first position in which the magnets are covered by the sleeve.

2. A magnetic cleaning tool according to claim 1 wherein the tool body includes a pair of stops located thereupon, the stops extending radially from the body by a distance less than or equal to a thickness of the sleeve.

3. A magnetic cleaning tool according to claim 1 wherein the magnets are permanent magnets.

4. A magnetic cleaning tool according to claim 1 wherein the magnets are fixed into a surface of the tool body.

5. A magnetic cleaning tool according to claim 1 wherein the magnets are embedded in the tool body to provide a flush surface with the surface of the tool body.

6. A magnetic cleaning tool according to claim 1 wherein the sleeve includes friction means adapted to engage with an interior surface of the wellbore.

7. A magnetic cleaning tool according to claim 1 wherein the sleeve and tool body are arranged such that movement of the tool body upwardly relative to the interior surface urges the sleeve to a second position in which the magnets are exposed.

8. A magnetic cleaning tool according to claim 7 wherein the tool body includes a pair of stops located thereupon, the stops extending radially from the body by a distance less than or equal to a thickness of the sleeve and the sleeve rests against the first stop in the first position and the second stop in the second position.

9. A magnetic cleaning tool according to claim 1 wherein the sleeve is arranged to rotate on the tool body.

10. A magnetic cleaning tool according to claim 1 wherein the tool includes first retaining means to hold the sleeve in the first position and the first retaining means comprises a pin located in a corresponding recess.

11. A magnetic cleaning tool according to claim 10 wherein the tool includes disengagement means to release the sleeve from the tool body when in the first position and the disengagement means is arranged to shear the pin in response to an increase in fluid pressure in the tool.

12. A magnetic cleaning tool according to claim 11 wherein the disengagement means comprises a radially expanding piston.

13. A magnetic cleaning tool according to claim 12 wherein the pin holds the sleeve and the piston in the first position, the piston being located in a longitudinal through bore of the tool.

14. A magnetic cleaning tool according to claim 12 wherein the piston includes a longitudinally arranged central bore which is co-linear with the through bore.

15. A magnetic cleaning tool according to claim 12 wherein the piston includes an upwardly facing first surface extending into the through bore.

16. A magnetic cleaning tool according to claim 12 wherein the central bore includes a portion having an increased diameter so that the piston can move into the portion and expand.

17. A magnetic cleaning tool according to claim 11 wherein sheared portions of the pin are retained in the tool to prevent additional loose debris in the wellbore.

18. A magnetic cleaning tool according to claim 10 wherein the tool includes second retaining means to hold the sleeve in the second position and the second retaining means comprises a spring loaded ball located in a corresponding recess.

19. A method of cleaning a wellbore, comprising the steps:

(a) mounting a magnetic cleaning tool according to claim 1;

(b) running the work string in the wellbore with the sleeve in a first position, covering the magnets;

(c) pulling the work string from the wellbore;

(d) moving the sleeve to a second position, so as to uncover the magnets; and (e) collecting ferrous debris at the magnets.

* * * * *